US005997416A

United States Patent [19]

Maruko

[11] Patent Number: 5,997,416

[45] Date of Patent: Dec. 7, 1999

[54] GOLF BALL

[75] Inventor: Takashi Maruko, Saitama, Japan

[73] Assignee: Bridgestone Sports Co., Ltd., Tokyo, Japan

[21] Appl. No.: 09/110,407

[22] Filed: Jul. 6, 1998

[30] Foreign Application Priority Data

Jul. 4, 1997 [JP] Japan ..... 9-179249
Jul. 22, 1997 [JP] Japan ..... 9-195298

[51] Int. Cl.[6] ..... A63B 37/06

[52] U.S. Cl. ..... 473/371; 273/DIG. 1; 273/DIG. 6; 273/DIG. 10; 273/DIG. 22

[58] Field of Search ..... 473/375, 372, 473/373, 374, 358; 273/DIG. 1, DIG. 6, DIG. 10, DIG. 22

[56] References Cited

U.S. PATENT DOCUMENTS 728,311 5/1903 Singer ..... 473/373 X 740,403 10/1903 Day ..... 473/375

*Primary Examiner*—George J. Marlo

*Attorney, Agent, or Firm*—Sughrue, Mion, Zinn, Macpeak & Seas, PLLC

[57] ABSTRACT

A golf ball includes a hollow core formed of a material having a specific gravity of 1.05–1.25 and having a concentric spherical inner cavity, a cover formed on the outer surface of the hollow core, and a resin layer applied onto the inner surface of the hollow core and having a thickness of 1–3 mm. The resin layer is preferably formed of a material having an Izod impact resistance of 50 J/m or greater. The hollow core preferably has a wall thickness of 7–11 mm. The Shore D hardness of the resin layer is preferably greater than that of the hollow core by at least 10. The golf ball does not suffer breakage of the hollow core due to an impact acting on the golf ball upon being hit, and has proper degrees of hardness and resilience in order to increase travel distance.

9 Claims, 1 Drawing Sheet

GOLF BALL

BACKGROUND OF THE INVENTION

1. Field of the Invention

The present invention relates to a hollow golf ball having a concentric spherical inner cavity.

2. Related Art

Solid golf balls, such as two-piece golf balls, three-piece golf balls, etc. are usually produced by a process which comprises compression or injection molding for enclosing a solid core with a cover material and for forming dimples on the cover material, and finishing processing such as coating, mark stamping, etc. In this case, a solid core lacking an inner cavity has conventionally been used as a core of the solid golf ball.

The present inventors have conceived a new structure of a golf ball which includes a hollow core having a spherical inner cavity and a cover formed on the outer surface thereof, and have reasoned that with this structure, the mass of the golf ball is concentrated at its outer peripheral portion, and consequently, the moment of inertia of the golf ball during travel considerably increases, so that spin motion during travel continues for a longer period of time, resulting in increased travel distance. Based on the above-described concept, the present inventors conducted a study in order to obtain such a hollow golf ball.

As a result, the present inventors found that since the impact resistance of a hollow core having a spherical inner cavity is lower than that of a solid core, when the golf ball is hit, the hollow core is broken due to an impact acting on the golf ball if only the outer surface of the hollow core is covered with a cover material. They also found that if the material of the hollow core does not have a proper specific gravity, the hollow core cannot have proper degrees of hardness and resilience, resulting in decreased travel distance.

SUMMARY OF THE INVENTION

The present invention has been achieved based on the above-mentioned findings. An object of the present invention is to provide a golf ball which includes a hollow core having a spherical inner cavity, which does not suffer breakage of the hollow core due to an impact acting on the golf ball upon being hit, and which has proper degrees of hardness and resilience in order to increase travel distance.

To achieve the above object, the present invention provides a golf ball comprising a hollow core formed of a material having a specific gravity of 1.05–1.25 and having a concentric spherical inner cavity, a cover formed on the outer surface of the hollow core, and a resin layer applied onto the inner surface of the hollow core and having a thickness of 1–3 mm.

Since the golf ball of the present invention has a concentric spherical inner cavity, the mass of the golf ball is concentrated at its outer peripheral portion. As a result, when a golf ball is traveling, its moment of inertia is considerably increased so that spin motion continues for a longer period of time, resulting in an increase in travel distance. Also, since the hollow core is reinforced from inside by means of the resin layer applied on the inner surface thereof, the hollow core has improved impact resistance. Consequently, there is prevented breakage of the hollow core, which would otherwise occur due to an impact acting on the golf ball when hit. Further, since the hollow core is formed of a material having a specific gravity of 1.05–1.25, the hardness and resilience of the hollow core fall within respective proper ranges, so that travel distance is increased.

DESCRIPTION OF THE INVENTION AND PREFERRED EMBODIMENTS

Figure 1:
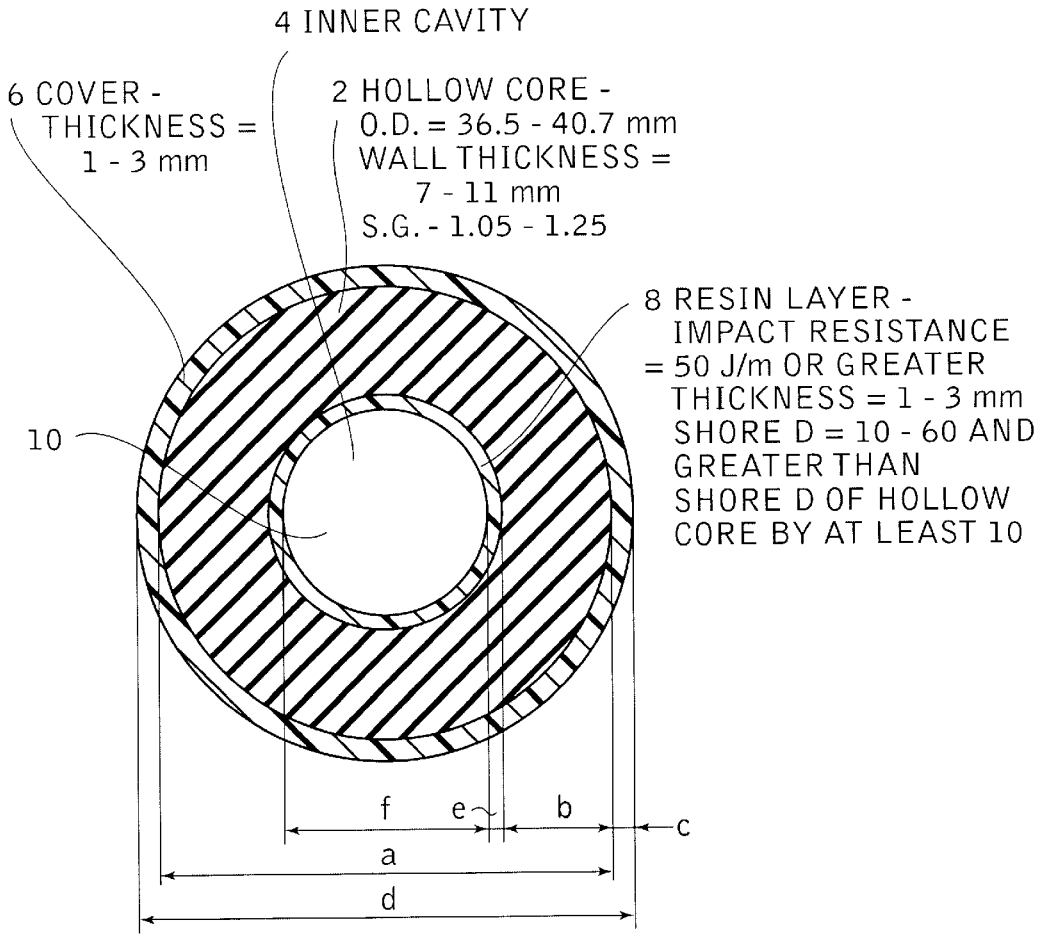
FIG. 1 is a sectional view showing a golf ball according to an embodiment of the present invention.

Next will be described the respective parts composing the golf ball as well as a method for manufacturing the golf ball. The size and weight of the golf ball of the present invention conforms to the Golf Rules. Accordingly, the golf ball is required to have a diameter of 42.67 mm or more and a weight of 45.92 g or less.

Hollow Core

The material of the hollow core is not particularly limited and there may be used vulcanized rubber containing as a main component polybutadiene rubber, polyisoprene rubber, natural rubber, silicone rubber, or like rubber. Preferably, vulcanized rubber containing polybutadiene rubber as a main component is used. The hollow core may have a single-layered structure made of a single type of material or a multi-layered structure composed of a plurality of layers each made of a different type of material.

In the golf ball of the present invention, in order to secure the hardness and resilience of the hollow core, the hollow core is formed of a material having a specific gravity of preferably 1.05–1.25, more preferably 1.14–1.22. If the specific gravity of the hollow core material is less than 1.05, proper hardness is not obtained. Also, if it is more than 1.25, resilience is decreased. That is, in either case travel distance is decreased. If the hollow core has a multi-layered structure as mentioned above, each of the layers is formed of a material having a specific gravity of preferably 1.05–1.25.

The outer diameter of the hollow core is preferably 36.5–40.7 mm, more preferably 38–40 mm. In order to secure proper resilience of the hollow core, the wall thickness thereof is determined to fall within a proper range, i.e., 7–11 mm, preferably 8–10 mm.

Cover

The material of the cover is not particularly limited and there may be used material such as ionomer resin, urethane resin, polyester resin, a mixture of urethane resin and polyester resin, or like resin. The cover preferably has a thickness of 1–3 mm, more preferably 1.5–2.5 mm. The cover may have a single-layered structure made of a single type of material or a multi-layered structure composed of a plurality of layers each made of a different type of material.

Resin Layer

As material of the resin layer, there is used material having an Izod impact resistance (impact resistance measured under an Izod impact test) of 50 J/m or more, more preferably 100 J/m or more. The Izod impact resistance is measured in accordance with a procedure using an ASTM 256 notch. The resin layer serves to reinforce the hollow core from inside. Therefore, if the impact resistance of the resin layer is low, sufficient effect of reinforcing the hollow core is not obtained. If the Izod impact resistance of the resin layer is less than 50 J/m, the hollow-core reinforcement effect of the resin layer is excessively weak, so that the hollow core may break due to an impact acting on the golf ball when hit. Preferably, an amorphous resin or a resin having a low crystallinity is used as material of the resin layer because of its high impact resistance.

The material of the resin layer is not particularly limited and there may be advantageously used material such as polyarylate, polycarbonate, polyester elastomer, ionomer resin, polyamide resin, polyether-sulphone, or like material.

The resin layer; i.e., the resin-made hollow sphere disposed within the inner cavity of the hollow core, may be manufactured in accordance with, for example, a method in which a pair of resin-made hemispheric cups are joined to each other, a method in which a resin-made hollow sphere is formed through blow forming, or a like method. However, the method of manufacturing the resin-made hollow sphere is not limited thereto. The resin layer may have a single-layered structure made of a single type of material or a multi-layered structure composed of a plurality of layers each made of a different type of material. If the resin layer has a multi-layered structure, each layer is formed of a material having an Izod impact resistance of 50 J/m or more.

The thickness of the resin layer is preferably 1–3 mm, more preferably 1–2 mm. If the thickness is less than 1 mm, sufficient effect of reinforcing the hollow core is not obtained, with the result that the hollow core is broken due to an impact acting on the golf ball when hit, whereas if the thickness is more than 3 mm, the resilience of the golf ball is lowered.

The inner diameter of the resin layer (the diameter of the spherical cavity within the golf ball) is preferably 8.7–24.7 mm, more preferably 13–22 mm. If the diameter of the spherical cavity is less than 8.7 mm, sufficient moment of inertia is not obtained, whereas if the diameter is more than 24.7 mm, the rubber portion volume of the golf ball is decreased accordingly with the result that resilience may decrease.

The means for applying the resin layer onto the inner surface of the hollow core is not particularly limited and there may be advantageously employed a method in which a resin layer is adhesively joined to the inner surface of the hollow core. With this method, the resin layer is firmly joined to the inner surface of the hollow core, to thereby improve the hollow-core reinforcement effect of the resin layer. Alternatively, without use of an adhesive, firm joint between the resin layer and the hollow core may be established through physically roughening the outer surface of the resin layer. In this case where the surface roughness of the outer surface of the resin layer is increased instead of adhesive being used, the surface roughness of the resin layer is made to a level of MR-5 or higher as measured in accordance with "Comparison Method for Surface Roughness of Plastic (JIS-k-7104)."

Preferably, the resin layer is harder than the hollow core. In this case, the value of (the Shore D hardness of the resin layer—the Shore D hardness of the hollow core) is preferably at least 10, more preferably 10–60, even more preferably 15–45, most preferably 20–35. If the resin layer is made harder than the hollow core, the innermost resin layer of the golf ball is not considerably deformed when the golf ball is hit; however, the hollow core disposed outside the resin layer is deformed instead, resulting in extended travel distance and favorable feel upon being hit (hereinafter called "hit feel").

Method of Manufacture

The golf ball of the present invention may be manufactured by an arbitrary method. For example, the following procedure may be advantageously employed.

(1) A hollow sphere serving as a resin layer is formed from resin. A pair of like hemispheric cups is molded from unvulcanized rubber. These two hemispheric cups are subjected to primary vulcanization (semi cure).

(2) An adhesive is applied on the outer surface of the resin layer. The two hemispheric cups which have undergone the primary vulcanization are put on the resin layer in such a manner that the cups enclose the resin layer. Next, the hemispheric cups are subjected to secondary vulcanization (full cure) so that the hemispheric cups are joined to each other, to thereby form a hollow core around the resin layer.

(3) A cover is formed on the hollow core through compression or injection molding, during which dimples are formed on the cover. The golf ball is then finished as desired through processing such as coating, mark-stamping, etc.

FIG. 1 is a sectional view showing a golf ball according to an embodiment of the present invention. In FIG. 1, reference numeral 2 denotes a spherical hollow core. The hollow core 2 is formed of a material having a specific gravity of 1.05–1.25, and has a concentric spherical inner cavity 4 The outer diameter a of the hollow core 2 is 36.5–40.7 mm. The wall thickness b of the hollow core 2 is 7–11 mm. In FIG. 1, reference numeral 6 denotes a cover formed on the outer surface of the hollow core 2. The thickness c of the cover 6 is 1–3 mm. The outer diameter d of the golf ball is approximately 42.7 mm. In FIG. 1, reference numeral 8 denotes a resin layer applied onto the inner surface of the hollow core 2 by means of an adhesive. The wall thickness e of the resin layer 8 is 1–3 mm. The inner diameter of the resin layer 8 (the diameter f of the spherical cavity 10) of the golf ball is 8.7–24.7 mm.

The golf ball of the present embodiment was manufactured according to the following procedure. First, a hollow sphere serving as a resin layer was formed from resin. Then, a pair of like hemispheric cups were molded through use of unvulcanized rubber. These two hemispheric cups were subjected to primary vulcanization (semi cure). Subsequently, an adhesive was applied on the outer surface of the resin layer. The two hemispheric cups which had undergone the primary vulcanization were put on the resin layer in such a manner that the cups enclosed the resin layer. Next, the hemispheric cups were subjected to secondary vulcanization (full cure) so that the hemispheric cups adhered to each other, to thereby form a hollow core around the resin layer. Thereafter, a cover was formed on the hollow core through compression molding, during which dimples were formed on the cover.

EXAMPLES

A golf ball shown in FIG. 1 was manufactured according to the aforementioned procedure. Respective golf balls of Examples and Comparative Examples shown in Table 4 were manufactured by use of cores having compositions shown in Tables 1, resin layers having compositions shown in Table 2, and covers having compositions shown in Table 3. Comparative Examples 1–4 are hollow golf balls. Comparative Example 5 is a conventional two-piece solid golf ball. Therefore, with regard to Comparative Example 5, the properties of the solid core are shown in the row for the "Core" in Table 4.

TABLE 1

Composition of Core

| | Composition (wt. %) | | | |
|---|---|---|---|---|
| | A | B | C | D |
| Polybutadiene rubber | 100.0 | 100.0 | 100.0 | 100.0 |
| Zinc oxide | 10.0 | 10.0 | 10.0 | 10.0 |

TABLE 1-continued

Composition of Core

| | Composition (wt. %) | | | |
|---|---|---|---|---|
| | A | B | C | D |
| Zinc acrylate | 33.0 | 33.0 | 33.0 | 33.0 |
| Barium sulfate | 15.5 | 8.3 | 23.0 | 28.7 |
| Dicumyl peroxide | 1.2 | 1.2 | 1.2 | 1.2 |
| Shore D hardness (surface hardness) | 56 | 55 | 56 | 56 |

Polybutadiene rubber: JSR BR01
Dicumyl peroxide: Perucumyl D manufactured by NOF Corp.

TABLE 2

Composition of Resin Layer

| | Composition (wt. %) | | | |
|---|---|---|---|---|
| | E | F | G | H |
| Polyarylate | 90.0 | 90.0 | 100.0 | — |
| Polyester | 10.0 | 10.0 | — | — |
| Polypropylene | — | — | — | 100.0 |
| Tungsten | 86.7 | 33.9 | — | 91.2 |
| Magnesium stearate | 1.0 | 1.0 | — | 1.0 |
| Shore D hardness | 84.0 | 82.0 | 90.0 | 79.0 |
| Melting point (° C.) | 225 | 225 | 230 | 160 |
| Izod impact resistance (J/m) | 102 | 110 | 108 | 18 |

Polyarylate: U-Polymer (U-8000) manufactured by Unitika, Ltd.
Polyester: Hi-Trel 4047 manufactured by Du Pont-Toray Co., Ltd.
Polypropylene: J-700G manufactured by Idemitsu Petrochemical Co., Ltd.
Tungsten: Type 1 of Tokyo Tungsten Co., Ltd.
Melting point: measured by DSC

TABLE 3

Composition of Cover

| | Composition (wt. %) | |
|---|---|---|
| | I | J |
| Ionomer resin A | 50.0 | 50.0 |
| Ionomer resin B | 50.0 | 50.0 |
| Barium sulfate | — | 16.0 |
| Titanium dioxide | 5.2 | 5.2 |
| Magnesium stearate | 1.2 | 1.2 |

Ionomer resin A: Hi-milan 1605 manufactured by Du Pont-Mitsui Polychemicals Co., Ltd.
Ionomer resin B: Hi-milan 1706

TABLE 4

| | | Example 1 | Example 2 | Example 3 | Comp. Ex. 1 | Comp. Ex. 2 | Comp. Ex. 3 | Comp. Ex. 4 | Comp. Ex. 5 |
|---|---|---|---|---|---|---|---|---|---|
| Composition | Core | A | A | B | B | C | D | A | B |
| | Resin Layer | E | F | E | G | F | F | H | — |
| | Cover | I | I | J | I | J | I | I | I |
| Resin Layer | Outer Diameter (mm) | 23.10 | 19.10 | 22.70 | 19.10 | 19.10 | 22.70 | 19.10 | None |
| | Thickness (mm) | 2.0 | 2.0 | 2.0 | 5.0 | 0.5 | 2.0 | 2.0 | — |
| | Inner Diameter (mm) | 19.1 | 15.1 | 18.7 | 9.1 | 18.1 | 18.7 | 15.1 | — |
| | Weight (g) | 6.30 | 3.04 | 6.07 | 4.14 | 0.91 | 4.43 | 3.04 | — |
| | Specific Gravity | 2.246 | 1.645 | 2.246 | 1.280 | 1.645 | 1.645 | 1.645 | — |
| Core | | Hollow | Hollow | Hollow | Hollow | Hollow | Hollow | Hollow | Solid |
| | Outer Diameter(mm) | 39.1 | 39.1 | 38.70 | 39.10 | 39.10 | 38.70 | 39.10 | 38.70 |
| | Thickness (mm) | 8.0 | 10.0 | 8.0 | 10.0 | 10.0 | 8.0 | 10.0 | — |
| Cover | Weight (g) | 36.12 | 36.22 | 34.17 | 36.22 | 35.20 | 35.19 | 36.22 | 35.20 |
| | Specific Gravity | 1.200 | 1.200 | 1.160 | 1.160 | 1.240 | 1.270 | 1.200 | 1.160 |
| | Weight (g) | 9.2 | 9.2 | 11.2 | 9.2 | 10.2 | 10.1 | 9.2 | 10.1 |
| | Thickness (mm) | 1.8 | 1.8 | 2.0 | 1.8 | 1.8 | 2.0 | 1.8 | 2.0 |
| | Specific Gravity | 0.990 | 0.990 | 1.100 | 0.990 | 1.100 | 0.990 | 0.990 | 0.990 |
| Ball | Outer Diameter (mm) | 42.70 | 42.70 | 42.70 | 42.70 | 42.70 | 42.70 | 42.70 | 42.70 |
| | Weight (g) | 45.3 | 45.4 | 45.4 | 45.4 | 45.4 | 45.3 | 45.4 | 45.3 |
| Moment of inertia | | 84.2 | 83.5 | 85.2 | 81.8 | 87.3 | 85.5 | 83.5 | 81.3 |
| Durability Defective Ratio | | 0/30 | 0/30 | 0/30 | 0/30 | 30/30 | 0/30 | 11/30 | 0/30 |
| Hit Feel | | Good | Good | Good | Bad | — | Good | — | Bad |
| Distance Test: | Peak Angle (°) | 12.1 | 12.0 | 12.1 | 11.8 | — | 11.6 | — | 12.0 |
| HS 40m/s W#1 | Carry (m) | 182.7 | 182.4 | 183.1 | 175.8 | — | 174.9 | — | 181.3 |
| | Total (m) | 201.6 | 200.0 | 202.5 | 195.3 | — | 192.4 | — | 197.7 |

In Tables 1 and 3, BROI (The Japan Synthetic Rubber Co., Ltd.) was used as polybutadiene rubber; Perucumyl D (NOF Corp.) was used as dicumyl peroxide; U-Polymer (U-8000) (Unitika, Ltd.) was used as polyarylate; Hi-Trel 4047 (Du Pont-Toray Co., Ltd.) was used as polyester; J-7000G (Idemitsu Petrochemical Co., Ltd.) was used as polypropylene; Type 1 of Tokyo Tungsten Co., Ltd. was used as tungsten; Hi-milan 1605 (Du Pont-Mitsui Polychemicals Co., Ltd.) was used as ionomer resin A; and Hi-milan 1706 (Du Pont-Mitsui Polychemicals Co., Ltd.) was used as ionomer resin B. The izod impact resistance of the polyarylate was 108 J/m, and that of the polypropylene was 22 J/m.

In manufacture of the golf balls of Examples 1–3 and Comparative Examples 1–4, the hemispheric cups were subjected to primary vulcanization at 130° C. for 12 minutes and to secondary vulcanization at 155° C. for 15 minutes. In manufacture of the conventional two-piece golf balls of Comparative Example 5, the cores were subjected to vulcanization at 155° C. for 15 minutes.

The golf balls of Examples and Comparative Examples were measured for their moments of inertia, subjected to a durability test, a hit-feel test, and a travel distance test. The measurement and tests were performed as follows:

(Measurement of Moment of Inertia)

Moment-of-inertia measurement was performed by use of a moment-of-inertia measuring device (M01–005 manufactured by INERTIA DYNAMICS INC.). The moment of inertia of each golf ball was calculated based on the difference between the period of vibration measured when the golf ball was placed on the jig of the device and that when the golf ball was not placed on the same.

(Durability Test)

The golf balls of Examples and Comparative Examples were subjected to a durability test. A swing robot manufactured by Miyama Co., Ltd. was used in the durability test. The golf balls were hit at a head speed of 45 m/s by J's Metal No. 1 Wood (loft angle: 9.5°) manufactured by Bridgestone Sports Co., Ltd. and visual check was performed to determine whether the balls had been damaged. The durability defective ratio is represented by (B/A) wherein A (denominator) is the number of hit golf balls and B (numerator) is the number of golf balls that suffered damage.

(Hit-Feel Test)

The golf balls were subjected to sensory evaluation test for hit feel in which three professional golfers hit the golf balls and evaluated the hit feel. Evaluation criteria for hit feel is as follows:

Good: Hit feel is good

Bad: Hit feel is bad (Distance Test)

Through use of a hitting test machine, the golf balls were hit by the No. 1 Wood at a head speed of 40 m/s. The launch angle, carry travel distance, and total travel distance were measured.

The results are shown in Table 4. As is apparent from Table 4, the golf balls of Example 1–3 yielded extended travel distance, having greater moments of inertia as compared with those of the conventional golf balls of Comparative Example 5 when traveling. In contrast, the golf balls of Comparative Example 1 having an excessively thick resin layer exhibited decreased travel distance due to decreased resilience, the golf balls of Comparative Example 2 having an excessively thin resin layer all suffered damage with their hollow cores cracked, the golf balls of Comparative Example 3 having an excessively large specific gravity exhibited decreased travel distance due to lowered resilience, and ⅓ of the golf balls of Comparative Example 4 having an excessively low Izod impact resistance suffered damage with their hollow cores cracked. In the cases of Comparative Examples 2 and 4, the distance test could not be conducted since the hit balls were damaged.

What is claimed is:

1. A golf ball comprising:

a hollow core formed of a material having a specific gravity of 1.05–1.25 and having a concentric spherical inner cavity;

a cover formed on the outer surface of the hollow core; and a resin layer applied onto the inner surface of the hollow core and having a thickness of 1–3 mm.

2. A golf ball according to claim 1, wherein the hollow core has a wall thickness of 7–11 mm.

3. A golf ball according to claim 1, wherein the outer diameter of the hollow core is 36.5–40.7 mm.

4. A golf ball according to claim 1, wherein the resin layer is formed of a material having an Izod impact resistance of 50 J/m or greater.

5. A golf ball according to claim 1, wherein the Shore D hardness of the resin layer is greater than that of the hollow core by at least 10.

6. A golf ball according to claim 5, wherein the value of (the Shore D hardness of the resin layer—the Shore D hardness of the hollow core) is 10–60.

7. A golf ball according to claim 1, wherein the cover has a thickness of 1–3 mm.

8. A golf ball according to claim 1, wherein the hollow core is formed of vulcanized rubber containing polybutadiene rubber as a main component.

9. A golf ball according to claim 1, wherein the resin layer is formed of a material selected from the group consisting of polyarylate, polycarbonate, polyester elastomer, ionomer resin, polyamide resin and polyether-sulphone.

* * * * *